US008393717B2

(12) United States Patent
Owaki et al.

(10) Patent No.: US 8,393,717 B2
(45) Date of Patent: Mar. 12, 2013

(54) LIQUID EJECTING HEAD AND METHOD OF INSPECTING LIQUID EJECTING HEAD

(75) Inventors: Hiroshige Owaki, Okaya (JP); Yoshinao Miyata, Matsukawa-mura (JP)

(73) Assignee: Seiko Epson Corporation, Tokyo (JP)

( * ) Notice: Subject to any disclaimer, the term of this patent is extended or adjusted under 35 U.S.C. 154(b) by 407 days.

(21) Appl. No.: 12/844,127

(22) Filed: Jul. 27, 2010

(65) Prior Publication Data

US 2011/0032310 A1 Feb. 10, 2011

(30) Foreign Application Priority Data

Aug. 4, 2009 (JP) ..... 2009-181951

(51) Int. Cl.
*B41J 2/045* (2006.01)

(52) U.S. Cl. ..... 347/70; 347/68; 347/50; 347/71

(58) Field of Classification Search ..... 347/68–72, 347/50, 19

See application file for complete search history.

(56) References Cited

FOREIGN PATENT DOCUMENTS

| | | |
|---|---|---|
| JP | 09-057973 | 3/1997 |
| JP | 09-193383 | 7/1997 |
| JP | 2008-221652 | 9/2008 |

*Primary Examiner* — Matthew Luu
*Assistant Examiner* — Henok Legesse
(74) *Attorney, Agent, or Firm* — Workman Nydegger

(57) ABSTRACT

A liquid ejecting head ejects a liquid from pressure generating chambers through nozzles by varying pressure of the pressure generating chambers. The liquid ejecting head includes a nozzle plate in which the nozzles are formed. A first passage forming board is joined to the nozzle plate. A first liquid passage, including the pressure generating chambers, is formed in the first passage forming board. A second passage forming board is joined to the surface of the first liquid passage forming board and has a second liquid passage communicating with the first liquid passage. A first electrode layer electrically connected to the liquid in the first liquid passage and a second, independent, electrode layer are disposed on a vibration plate. Each of the first and second electrode layers includes a terminal drawn to the outside of a junction portion joining the first and second passage forming boards to each other.

5 Claims, 6 Drawing Sheets

LIQUID EJECTING HEAD AND METHOD OF INSPECTING LIQUID EJECTING HEAD

The entire disclosure of Japanese Patent Application No: 2009-181951, filed Aug. 4, 2009 are expressly incorporated by reference herein.

BACKGROUND

1. Technical Field

The present invention relates to a liquid ejecting head capable of ejecting liquid droplets from nozzles and a method of inspecting the liquid ejecting head, and more particularly, to an ink jet printing head capable of ejecting ink droplets and a method of inspecting the ink jet printing head.

2. Related Art

A representative example of a liquid ejecting head is an ink jet printing head which includes a plurality of pressure generating chambers communicating with nozzles ejecting ink droplets and a reservoir communicating with the plurality of pressure generating chambers. In the ink jet printing head, ink supplied from the reservoir to the pressure generating chambers is pressurized by pressure generating units such as piezoelectric elements to eject ink droplets from the nozzles. For example, there was suggested an ink jet printing head which includes a plurality of pressure generating chambers, ink supply passages respectively communicating with the plurality of pressure generating chambers, a passage forming board including communication portions respectively communicating with the pressure generating chamber via the ink supply passage, piezoelectric elements formed on one surface of the passage forming board via a vibration plate, and a protective board including a piezoelectric element retaining section joined to the passage forming board and protecting the piezoelectric elements. In this ink jet printing head, a reservoir portion forming a reservoir along with the communication portions is formed through the protective board.

In the ink jet printing head with such a configuration, a breakage may occur from vibration during the manufacturing process. For example, since the linear expansion coefficient of the passage forming board is different from that of the nozzle plate in which the nozzles are punched, the passage forming board may be bent and thus a breakage may occur in the vibration plate.

For this reason, an inspecting process of inspecting whether a breakage occurs in the vibration plate is performed when the product is completed. When the nozzle plate is formed of a conductive material, it can be relatively simply inspected whether a breakage occurs in the vibration plate by detecting a conductive state between the nozzle plate, a lower electrode film, a first independent electrode layer, and a second independent electrode layer in a state where a liquid such as ink fills from the reservoir to the pressure generating chambers (for example, see JP-A-2008-221652).

When the nozzle plate is formed of a conductive material, as described above, a breakage in the vibration plate can be inspected by detecting the conductive state between the nozzle plate and the lower electrode film. However, when the nozzle plate is formed of an insulating material, a problem may arise in that this inspecting process may not be used and a breakage in the vibration plate may not be detected easily.

This problem may arise not only in the ink jet printing head but also in a liquid ejecting head ejecting a liquid other than ink.

SUMMARY

An advantage of some aspects of the invention is that it provides a liquid ejecting head and a method of inspecting the liquid ejecting head to detect occurrence of a breakage in a vibration plate relatively easily.

According to an aspect of the invention, there is provided a liquid ejecting head ejects a liquid storing pressure generating chambers from nozzles by varying pressure of the pressure generating chambers by pressure generating units. The liquid ejecting head includes: a nozzle plate in which the nozzles are formed and which is formed of an insulating material; a first passage forming board to which the nozzle plate is joined and in which a first liquid passage including the pressure generating chambers is formed and which is formed of an insulating material; a vibration plate which is disposed on the first passage forming board and forms one surface of the first liquid passage; and a second passage forming board which is joined to the surface of the first liquid passage forming board close to the vibration plate and has a second liquid passage communicating with the first liquid passage. A first electrode layer electrically connected to the liquid storing the first liquid passage and a second electrode layer independent from the first electrode layer are disposed on the vibration plate. The first and second electrode layers each include a terminal drawn to the outside of a junction portion joining the first and second passage forming boards to each other.

According to another aspect of the invention, there is provided a method of inspecting the liquid ejecting head. The method including inspecting a conductive state between the terminals of the first and second electrode layers in a state where the first liquid passage of the liquid ejecting head is stored with the liquid.

According to the aspect of the invention, it is possible to determine whether a breakage occurs in the vibration plate, by detecting the conductive state between the terminals of the first and second electrode layers in the state where the first liquid passage is stored with the conductive liquid. In particular, since the terminals of the first and second electrode layers are disposed outside the junction portion of the first and second passage forming boards, it is possible to easily detect the conductive state between the first and second electrode layers in the inspecting process. In this way, since a good product with no breakage in the vibration plate is manufactured, occurrence of initial failure is considerably reduced.

In the liquid ejecting head, the first electrode layer may have an exposure portion exposed to the first or second liquid passage and may be electrically connected to the liquid storing the first liquid passage via the exposure portion. With such a configuration, the first electrode layer is electrically connected to the liquid in a reliable manner.

In the liquid ejecting head, the second passage forming board may be provided with a retaining section which is a space receiving the pressure generating units. The second electrode layer may be disposed in a portion corresponding to the retaining section on the vibration plate. With such a configuration, it is possible to more reliably detect whether a breakage occurs in the major portions of the vibration plate.

In the liquid ejecting head, the second electrode layer may be disposed in a portion facing an outer edge of the retaining section. A breakage in the vibration portion easily occurs in this portion. Therefore, by disposing the second electrode layer, it is possible to more reliably detect a breakage in the vibration plate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail.

Figure 1:
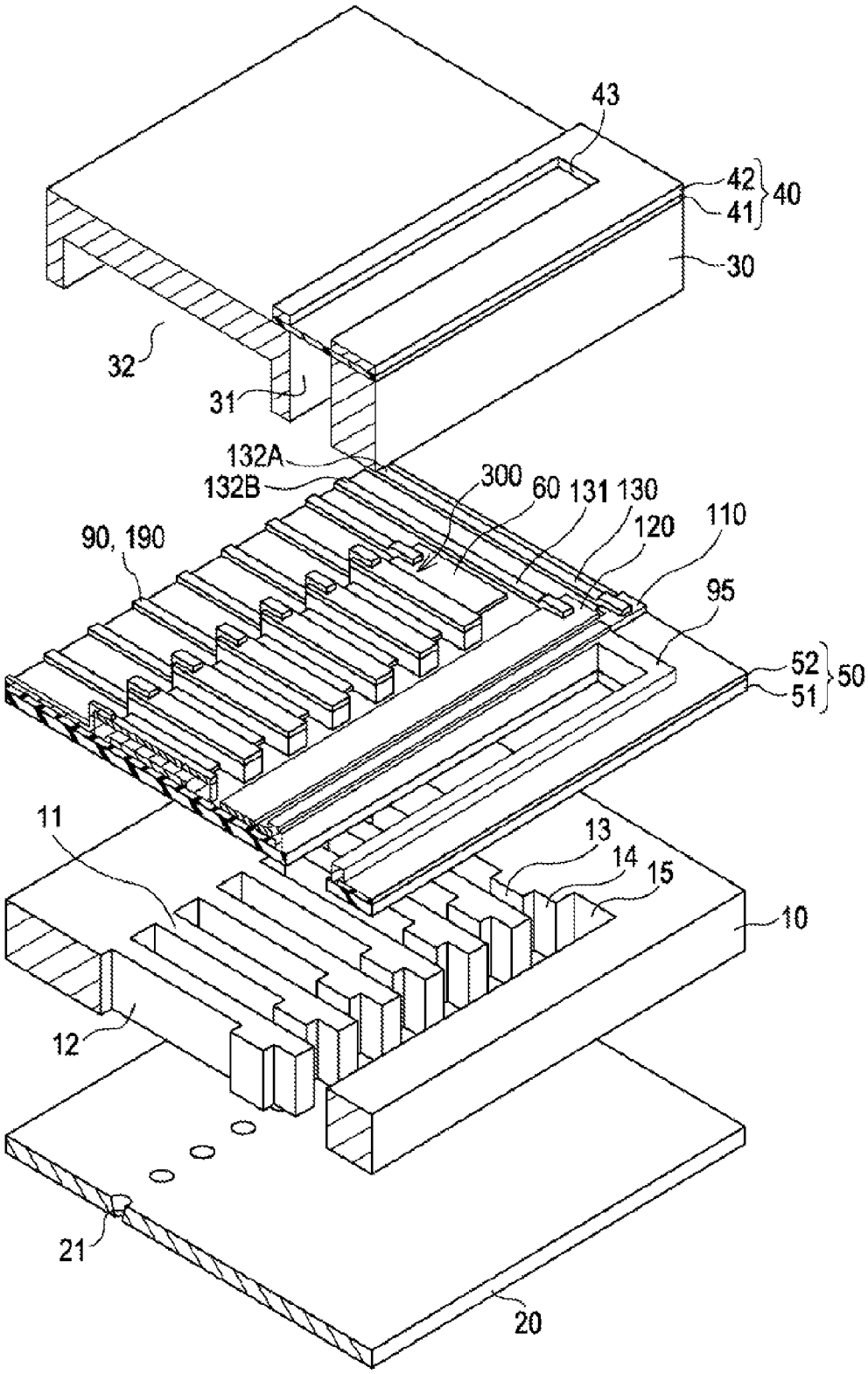
FIG. 1 is an exploded perspective view schematically illustrating a printing head according to an embodiment of the invention.
Figure 2A:
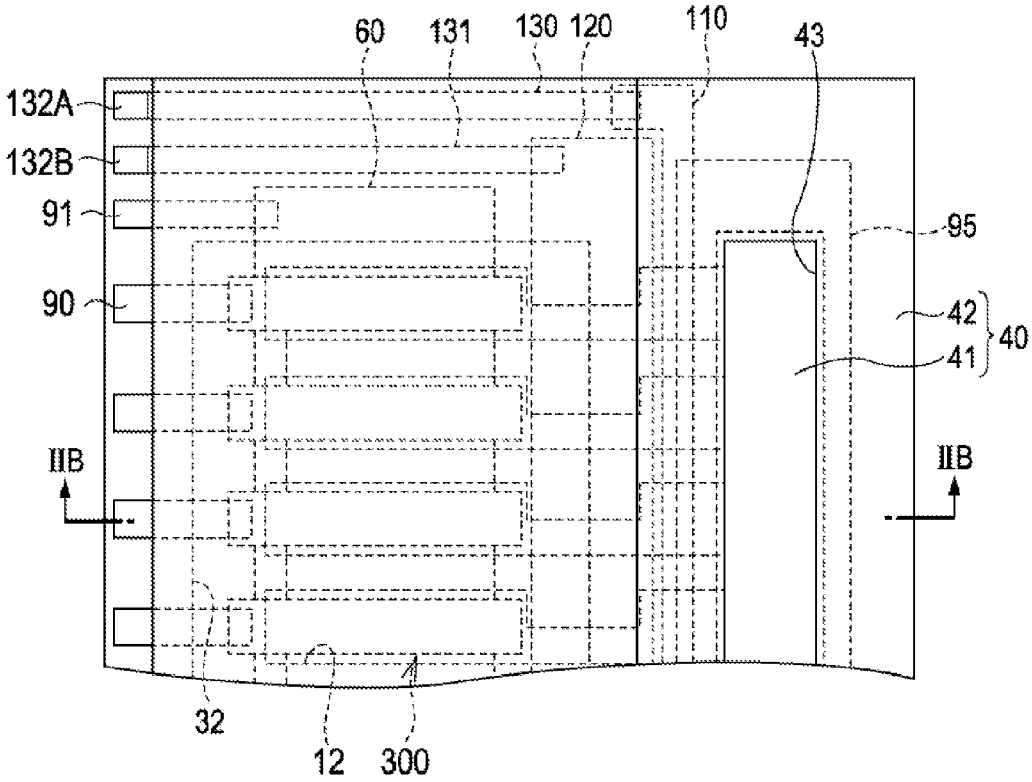
FIGS. 2A and 2B are a plan view and a sectional view illustrating the printing head according to the embodiment of the invention, respectively.
Figure 3:
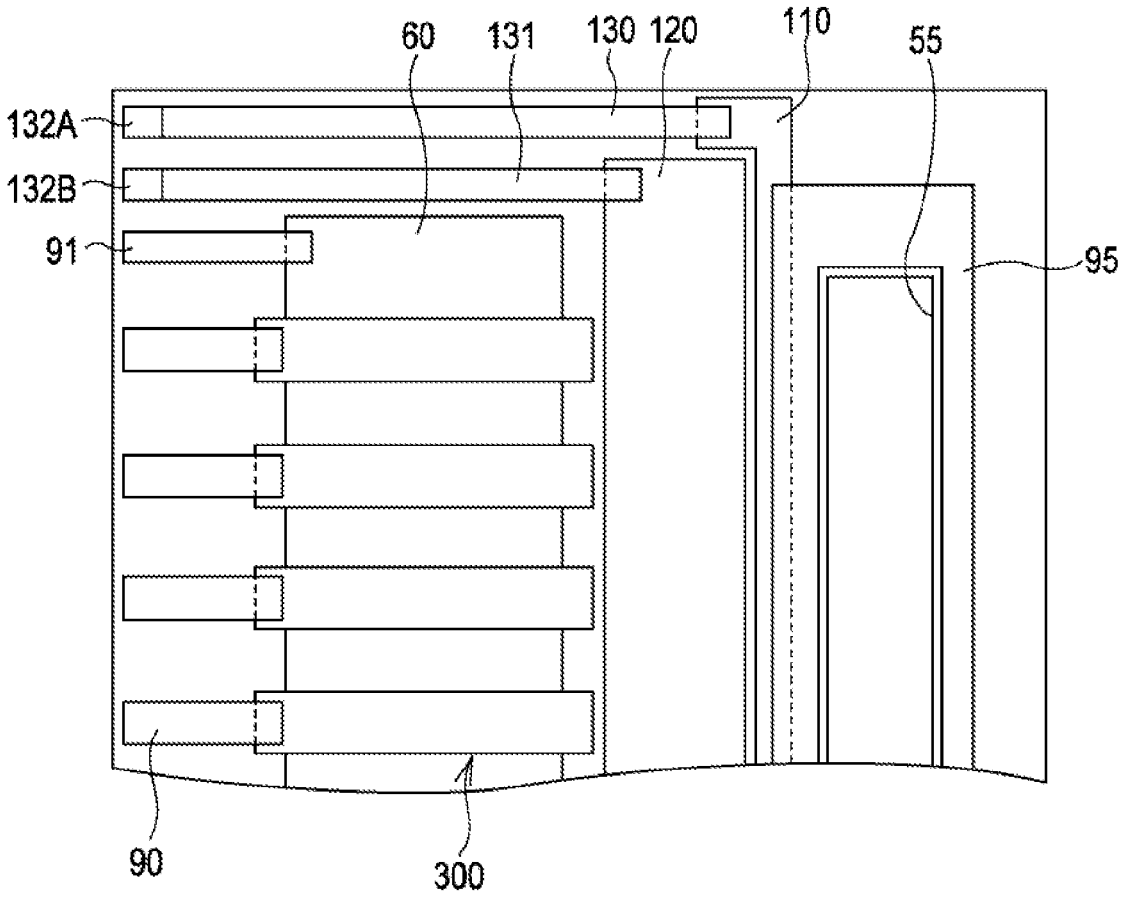
FIG. 3 is a plan view illustrating an electrode structure formed on a vibration plate according to the embodiment of the invention.

FIG. 1 is an exploded perspective view schematically illustrating an ink jet printing head according to an embodiment of the invention. FIG. 2A is a plan view of FIG. 1. FIG. 2A is a sectional view taken along the line IIA-IIA of FIG. 1. FIG. 3 is a plan view illustrating an electrode structure formed on a vibration plate.

Figure 2B:
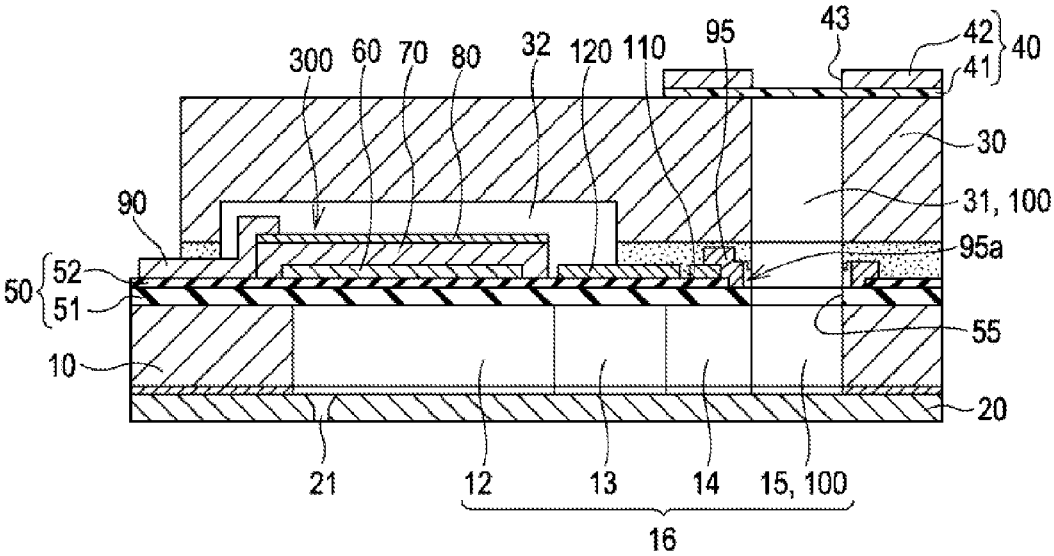

As shown in FIG. 1 and FIGS. 2A and 2B, a plurality of pressure generating chambers 12 partitioned by partition walls 11 are formed in a first passage forming board 10 of the ink jet printing head, which is an example of a liquid ejecting head. In this embodiment, the plurality of pressure generating chambers 12 is formed in parallel in the width direction (transverse direction). A nozzle 21 formed through a nozzle plate 20, which is described below, communicates with each pressure generating chamber 12.

Ink supply passages 13 each communicating with the pressure generating chamber 12, communication passages 14, and a communication portion 15 are formed in the first passage forming board 10. That is, an ink passage (first liquid passage) 16 formed by the pressure generating chamber 12, the ink supply passage 13, and the communication passage 14, and the communication portion 15 are formed in the first passage forming board 10.

The communication portion 15 communicates with a reservoir portion (second liquid passage) 31 formed in a second passage forming board 30, which is described below, and forms a part of a reservoir 100 which is common to the pressure generating chambers 12. Since the ink supply passage 13 is formed so as to have a cross-sectional area narrower than that of the pressure generating chamber 12, passage resistance of ink flowing from the communication portion 15 to the pressure generating chamber 12 is uniformly maintained. In this embodiment, since the ink supply passage 13 is narrowed from the one side thereof, the width of the ink supply passage 13 is narrower than that of the pressure generating chamber 12. The communication passage 14 is partitioned by the partition wall 11, like the pressure generating chamber 12. In this embodiment, the width of the communication passage 14 is substantially the same as that of the pressure generating chamber 12.

The first passage forming board 10 is formed of, for example, a silicon single crystal board in a plane direction (110). A vibration plate 50 including an elastic film 51 formed of an oxide film by, for example, thermal oxidation is formed on one surface of the first passage forming board 10. The ink passage 16 including the pressure generating chamber 12 is formed by etching the first passage forming board 10 from the other surface of the first passage forming board 10. Therefore, one surfaces of the pressure generating chambers 12, the ink supply passages 13, and the communication passages 14 are formed by the vibration plate (the elastic film 51).

A nozzle plate 20 formed of an insulating material is attached on the opened surface of the first passage forming board 10 by an adhesive or the like. The plurality of nozzles 21 communicating with the pressure generating chambers 12, respectively, are punched through the nozzle plate 20, as described above. Specifically, each nozzle 21 communicates with the vicinity of the end of each pressure generating chamber 12 on the opposite side of the ink supply passage 13. Here, the nozzle plate 20 formed of an insulating material may be entirely formed of an insulating material. Alternatively, for example, the surface of the nozzle plate 20 may be covered with an insulating material. In this embodiment, for example, a plate made by forming a native oxide film on the surface of a silicon single crystal board is used as the nozzle plate 20. The oxide film on the surface of the nozzle plate 20 is not limited to the native oxide film, but may be formed by thermal oxidation.

On the other hand, the elastic film 51 is formed on the surface of the first passage forming board 10 on the opposite side of the nozzle plate 20, as described above. An insulating film 52 formed of an oxide film of a material different from that of the elastic film 51 is formed on the elastic film 51. The vibration plate 50 includes the elastic film 51 and the insulating film 52. On the vibration plate 50, piezoelectric elements 300 including a lower electrode film 60, a piezoelectric layer 70, and an upper electrode film 80 are formed as pressure generating units. In this embodiment, the lower electrode 60 serves as a common electrode of the piezoelectric element 300 and the upper electrode film 80 serves as an individual electrode of the piezoelectric element 300. Of course, the upper electrode film 80 serves as a common electrode of the piezoelectric element 300 and the lower electrode 60 serves as an individual electrode of the piezoelectric element 300 depending on the structure of a driving circuit or a wiring. The piezoelectric element 300 and the vibration plate 50 in which deformation occurs by driving of the piezoelectric element 300 are called an actuator.

A second passage forming board 30 in which the reservoir portion 31 serving as the second liquid passage is formed is joined on the first passage forming board 10. The reservoir portion 31 communicates with the communication portion 15 of the first passage forming board 10 via an opening 55 formed through the vibration plate 50 so as to form the reservoir 100 which is common to the plurality of pressure generating chambers 12. A piezoelectric element retaining section 32 which is a space retaining the piezoelectric element 300 is disposed in the second passage forming board 30. The piezoelectric element retaining section 32 may be sealed hermetically or may not be hermetically sealed.

A compliance board 40 including a sealing film 41 formed of a material with low rigidity and flexibility and a fixing plate 42 formed of a hard material such as metal is joined on the second passage forming board 30. An opening 43 is formed in a part of the fixing plate 42 on the opposite side of the reservoir 100. One surface of the reservoir 100 is sealed only by the sealing film 41.

Here, a first lead electrode 90 formed of, for example, gold (Au) is connected to the upper electrode film 80 which is the individual electrode of each piezoelectric element 300. The first lead electrode 90 extends up to the outside of a junction portion in which the first passage forming board 10 and the second passage forming board 30 are joined to each other. The lower electrode film 60 serving as the common electrode of the piezoelectric elements 300 continuously extends in the portion opposite to the pressure generating chambers 12 in the arrangement direction of the pressure generating chambers 12. A second lead electrode 91 is connected to the lower electrode film 60 in an outside portion of the row of the pressure generating chambers 12. Like the first lead electrode 90, the second lead electrode 91 also extends up to the outside of the junction portion of the first passage forming board 10 and the second passage forming board 30. That is, the first lead electrode 90 and the second lead electrode 91 extend up to the outside of the piezoelectric element retaining section 32 and are exposed to the outside. External wirings (not shown) formed of an FPC are connected to the front ends of the first lead electrode 90 and the second lead electrode 91.

A first electrode layer electrically connected to the liquid storing the ink passage 16 and a second electrode layer independent from the first electrode layer are disposed on the vibration plate 50. In this embodiment, a first independent electrode layer 110 and an independent wiring layer 95 are disposed as the first electrode layer and a second independent electrode layer 120 is disposed as the second electrode layer.

In a portion being in the vicinity of the opening 55 of the vibration plate 50 and facing the communication passage 14, the first independent electrode layer 110 is continuously formed in the arrangement direction of the pressure generating chambers 12. The first independent electrode layer 110 is disposed independently from the lower electrode film 60, but is formed in the same layer as that of the lower electrode film 60. The independent wiring layer 95 is continuously formed on the circumference of the opening 55 and is connected to the first independent electrode layer 110. The independent wiring layer 95 is formed in the same layer as that of the first lead electrode 90 and the second lead electrode 91 described above.

The independent wiring layer 95 is formed to block the opening 55 of the vibration plate 50 when the ink passage 16 is formed in the first passage forming board 10, as described below. Therefore, the independent wiring layer 95 is removed after the ink passage 16 is formed in the first passage forming board 10. As a consequence, the independent wiring layer 95 has an exposure portion 95*a* exposed to the inside of the ink passage 16. Therefore, when the ink passage 16 is filled with a conductive liquid such as ink, the exposure portion 95*a* of the independent wiring layer 95 is electrically connected to the liquid in the ink passage 16. The first independent electrode layer 110 is also electrically connected to the liquid in the ink passage 16 via the independent wiring layer 95.

In this embodiment, the second independent electrode layer 120 is disposed in a portion facing the ink supply passage 13 and the communication passage 14 of the vibration plate 50, that is, a portion between the first independent electrode layer 110 and the lower electrode film 60. In this embodiment, the second independent electrode layer 120 is formed as the same layer as the lower electrode film 60, but is independent from the lower electrode film 60 and the first independent electrode layer 110.

One end of a first cable layer 130 is connected to the first independent electrode layer 110 and the other end of the first cable layer 130 extends up to the outside of the junction portion of the first passage forming board 10 and the second passage forming board 30. Likewise, one end of a second cable layer 131 is connected to the second independent electrode layer 120 and the other end of the second cable layer 131 extends up to the outside of the junction portion of the first passage forming board 10 and the second passage forming board 30. That is, the first cable layer 130 and the second cable layer 131 extend up to the outside of the piezoelectric element retaining section 32 and are exposed to the outside. The front ends of the first cable layer 130 and the second cable layer 131 serve as terminals 132 to which an inspecting probe, which is described below, is connected.

In the ink jet printing head according to this embodiment, ink is acquired from an external ink supply unit (not shown), the inside from the reservoir 100 to the nozzles 21 is filled with the ink, and the piezoelectric elements 300 are driven by applying a voltage between the lower electrode film 60 and the upper electrode film 80 corresponding to the pressure generating chambers 12 via the external wirings in accordance with a printing signal from the driving circuit (not shown). In this way, the vibration plate 50 is bent and deformed, the pressure in the pressure generating chambers 12 is increased, and thus ink droplets are ejected from the nozzles 21.

In the ink jet printing head according to the above-described embodiment, it is possible to detect whether the vibration plate 50 is broken in a manufacturing process relatively easily and exactly. Therefore, a good product can be provided for a user and the occurrence of breakdown such as initial failure can be considerably reduced. As a consequence, it is possible to improve reliability for a user.

Hereinafter, with reference to FIGS. 4A to 4D, FIGS. 5A to 5D, and FIG. 6, it will be described about a method of manufacturing the ink jet printing head according to the embodiment and a process of inspecting the ink jet printing head. FIGS. 4A to 4D and FIGS. 5A to 5D are sectional views illustrating the method of manufacturing the printing head. FIG. 6 is a schematic diagram illustrating the process of inspecting the printing head.

Figure 4A:
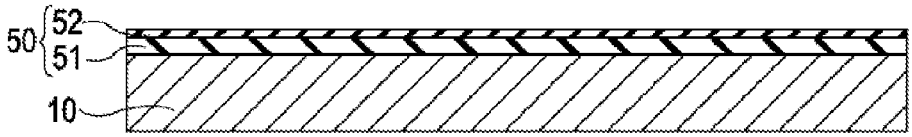
FIGS. 4A to 4D are sectional views illustrating steps of manufacturing the printing head according to the embodiment of the invention.

First, as shown in FIG. 4A, the vibration plate 50 is formed on one surface of the first passage forming board 10. That is, the elastic film 51 formed of an oxide film by thermal oxidation is disposed on the surface of the first passage forming board 10. Subsequently, the insulating film 52 formed of an oxide film of a material different from that of the elastic film 51 is disposed on the elastic film 51.

Figure 4B:
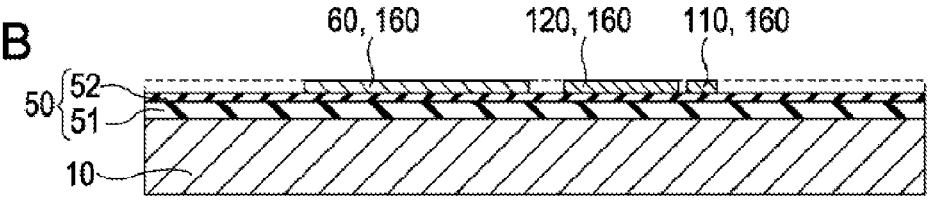

Subsequently, as shown in FIG. 4B, a first metal film 160 is formed on the entire surface of the insulating film 52. The lower electrode 60, the first independent electrode layer 110, and the second independent electrode layer 120 are formed by patterning the first metal film 160 (see FIG. 3).

Figure 4C:
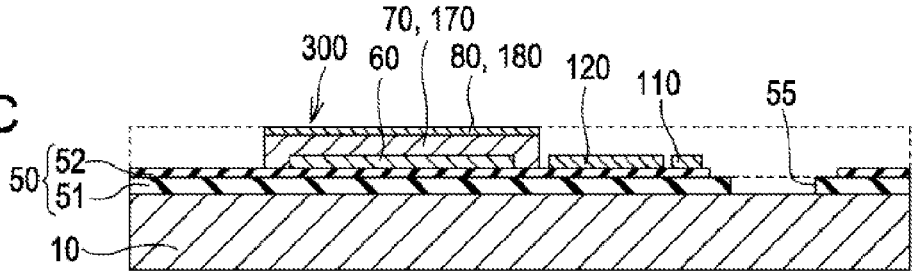

Subsequently, as shown in FIG. 4C, a piezoelectric material layer 170 formed of, for example, lead zirconate titanate (PZT) and a second metal film 180 are formed on the entire surface of the first passage forming board 10. The piezoelectric element 300 including lower electrode film 60, the piezoelectric layer 70, and the upper electrode film 80 is formed in a region facing each pressure generating chamber 12 by patterning the piezoelectric material layer 170 and the second metal film 180. At this time, in the vibration plate 50, the opening 55 is formed in a portion facing the communication portion 15. That is, the opening 55 is formed by sequentially etching the insulating film 52 and the elastic film 51.

Figure 4D:
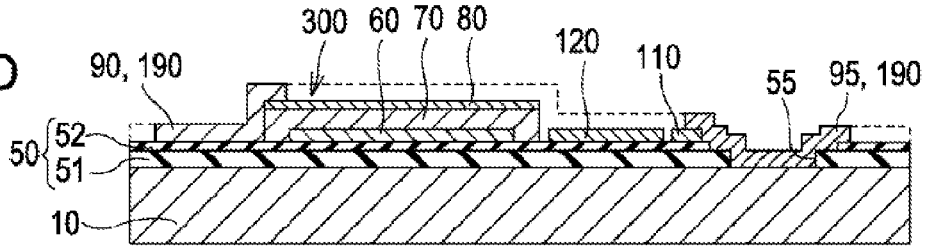

Subsequently, as shown in FIG. 4D, a third metal film 190 is formed on the entire one surface of the first passage forming board 10. The first lead electrode 90, the second lead electrode 91, the first cable layer 130, and the second cable layer 131 are formed by patterning the third metal film 190 in each of the piezoelectric elements 300 (see FIG. 3). The independent wiring layer 95 independent from the first lead electrode 90 and the second lead electrode 91 is formed in a portion facing the opening 55 of the vibration plate 50. That is, the opening 55 is sealed by the independent wiring layer 95.

Figure 5A:
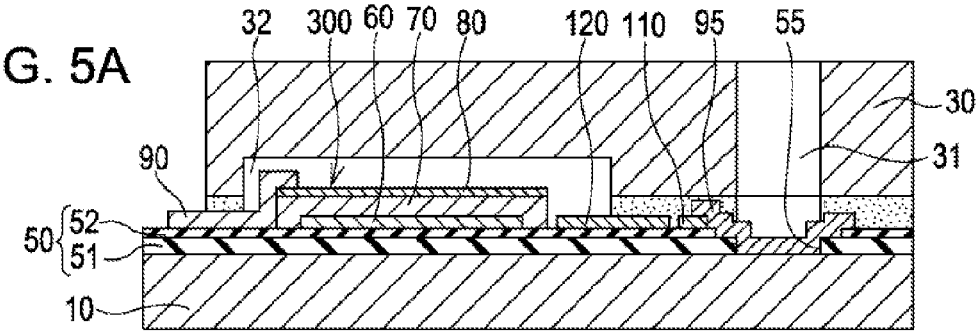
FIGS. 5A to 5D are sectional views illustrating steps of manufacturing the printing head according to the embodiment of the invention.
Figure 5B:
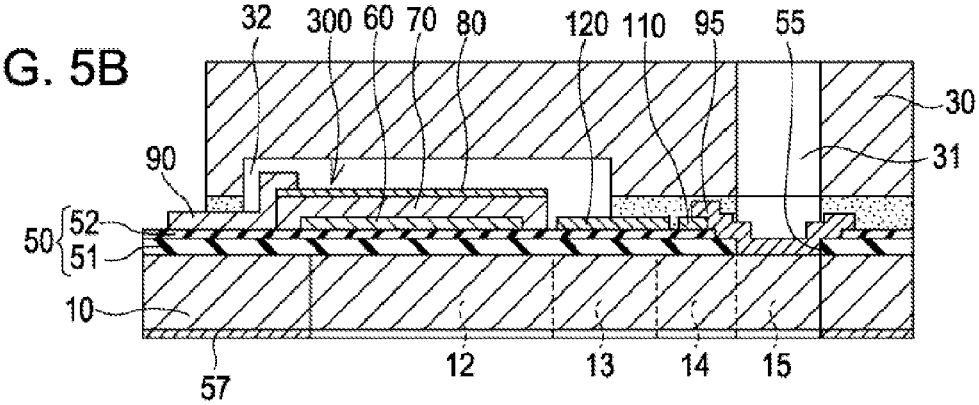
Figure 5C:
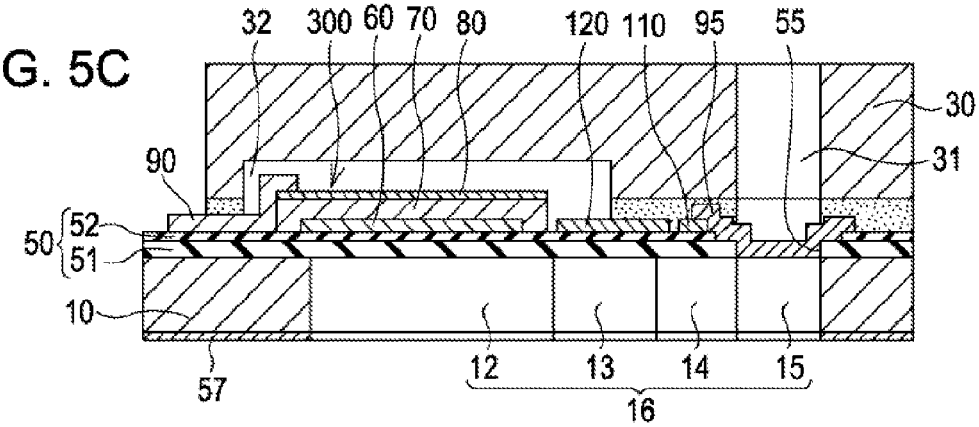
Figure 6:
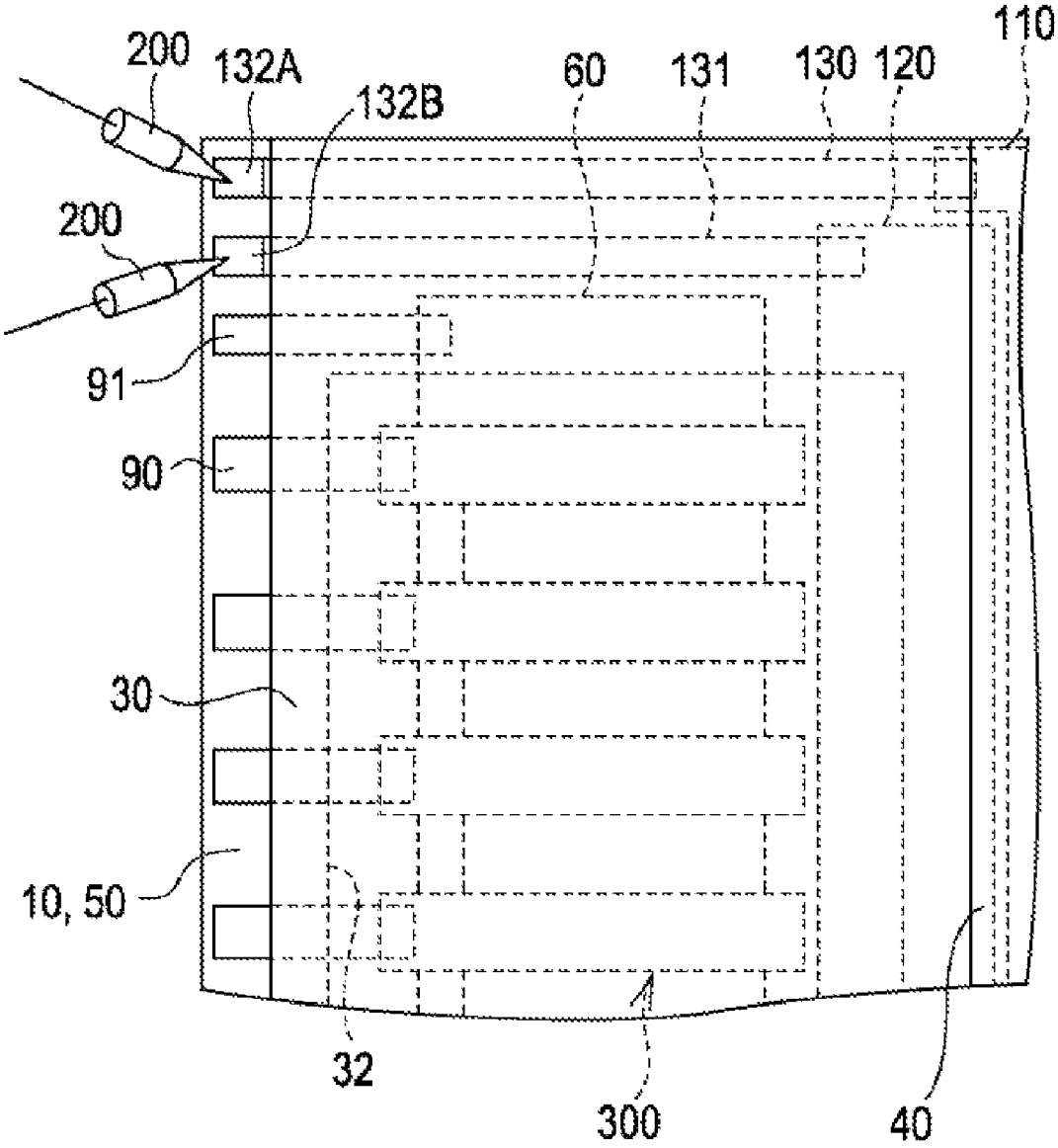
FIG. 6 is a diagram schematically illustrating a method of inspecting the printing head according to the embodiment of the invention.

Subsequently, as shown in FIG. 5A, the second passage forming board 30 in which the reservoir portion 31 and the piezoelectric element retaining section 32 are formed is joined to one surface of the first passage forming board 10. Subsequently, as shown in FIG. 5B, a protective film 57 is newly formed on the other surface of the first passage forming board 10 and is patterned in a predetermined shape. As shown in FIG. 5C, the ink passage 16 such as the pressure generating chamber 12 is formed in the first passage forming board 10 by subjecting the first passage forming board 10 to anisotropic etching (wet etching) by using the protective film 57 as a mask. Specifically, the pressure generating chambers 12, the ink supply passages 13, the communication passages 14, and the communication portion 15 are simultaneously formed by etching the first passage forming board 10 with an etchant such as a water solution of potassium hydroxide (KOH) until the elastic film 51 and the independent wiring layer 95 are exposed.

Since the opening 55 is sealed by the independent wiring layer 95 upon forming the pressure generating chambers 12 and the like, the etchant does not flow toward the second passage forming board 30 via the opening 55. In this way, it is possible to prevent line disconnection or the like due to the attachment of the etchant to a connection wiring (not shown) disposed on the surface of the second passage forming board 30. Moreover, the second passage forming board 30 is not etched since the etchant infiltrates into the reservoir portion 31.

Figure 5D:
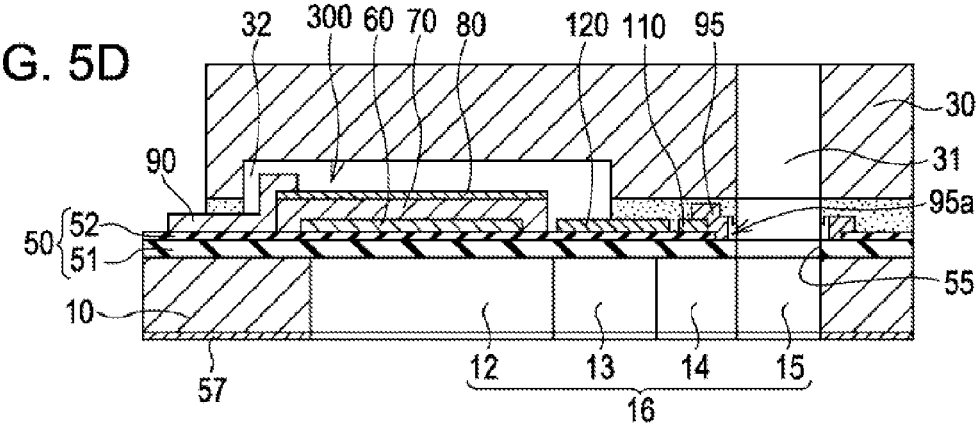

Subsequently, as shown in FIG. 5D, the independent wiring layer 95 in the opening 55 is removed from the communication portion 15 by wet etching. In this way, the reservoir 100 is formed so as to communicate with the communication portion 15 and the reservoir portion 31 via the opening 55. By removing the independent wiring layer 95 in this process, the end surface of the independent wiring layer 95 is exposed to the inside of the ink passage 16. That is, the end surface of the independent wiring layer 95 exposed to the inside of the ink passage 16 serves as the exposure portion 95*a*.

Subsequently, the ink jet printing head is manufactured by joining the compliance board 40 to the second passage forming board 30 and joining the nozzle plate 20, in which the nozzles 21 are formed, to the surface of the first passage forming board 10 opposite to the second passage forming board 30. In the above description, the chip size of the first passage forming board 10 and the second passage forming board 30 are exemplified in describing the method of manufacturing the ink jet printing head. However, in effect, a plurality of the first passage forming boards 10 and a plurality of the second passage forming boards 30 are integrally formed in a silicon wafer and are finally divided into pieces with one chip size.

When the ink jet printing head is manufactured in this manner, the inspecting process is performed subsequently. Specifically, in the state where the liquid such as ink stores from the reservoir 100 to the pressure generating chambers 12, a conductive state is detected between the first electrode layer (the first independent electrode layer 110 and the independent wiring layer 95) and the second electrode layer (the second independent electrode layer 120). The method of detecting the conductive state is not particularly limited. For example, as shown in FIG. 6, predetermined probe pins 200 are connected to a terminal 132A of the first cable layer 130 connected to the first independent electrode layer 110 and a terminal 132B of the second cable layer 131 connected to the second independent electrode layer 120 to measure a resistant value between the both probe pins 200.

From the measurement result, it is determined whether both the electrode layers are in the conductive state or in an insulation state. That is, it is determined whether a breakage occurs in the vibration plate 50 corresponding to the second independent electrode layer 120. When the breakage occurs in the vibration plate 50 corresponding to the second independent electrode layer 120, the liquid in the ink passage 16 flows in the breakage, the second independent electrode layer 120 and the liquid become the conductive state, and thus the first independent electrode layer 110 and the second independent electrode layer 120 become the conductive state consequently. On the contrary, when the breakage does not occur in the vibration plate, the insulation state is maintained between the first independent electrode layer 110 and the second independent electrode layer 120.

By determining whether the first independent electrode layer 110 and the second independent electrode layer 120 are in the conductive state or in the insulation state, it is possible to determine whether the breakage occurs in the vibration plate 50 corresponding to the second independent electrode layer 120 relatively easily and exactly. Therefore, by performing the inspecting process, it is possible to considerably reduce the occurrence of initial failure when a user uses the ink jet printing head.

In this embodiment, the terminals 132 of the first cable layer 130 and the second cable layer 131 connected to the first independent electrode layer 110 and the second independent electrode layer 120 are disposed outside the junction portion of the first passage forming board 10 and the second passage forming board 30, respectively. With such a configuration, it is possible to more easily detect the conductive state between the first independent electrode layer 110 and the second independent electrode layer 120 even after the product is manufactured.

In this embodiment, it is determined whether the first independent electrode layer 110 and the second independent electrode layer 120 is in the conductive state in the inspecting process. However, it may be determined whether the first independent electrode layer 110 and the lower electrode film 60 is in a conductive state. In this way, it is possible to determine whether a breakage occurs in the portion facing the lower electrode film 60 of the vibration plate 50. That is, the lower electrode film 60 as well as the second independent electrode layer 120 may function as the second electrode layer independent from the first electrode layer (the first independent electrode layer 110 and the independent wiring layer 95).

In this embodiment, the second independent electrode layer 120 serving as the second electrode layer is disposed on the circumference of the piezoelectric element retaining section 32, where a breakage easily occurs in the vibration plate 50, that is, the portion facing the ink supply passage 13 and the communication passage 14. However, the region where the second independent electrode layer 120 is formed is not particularly limited, but may be appropriately determined, as necessary. That is, the second independent electrode layer 120 may be formed in a desired portion in which it is detected whether a breakage occurs in the vibration plate 50.

In this embodiment, the first independent electrode layer 110 and the independent wiring layer 95 are used as the first electrode layer. The configuration of the first electrode layer is not particularly limited. Of course, the first electrode layer may not be formed by the first independent electrode layer 110 and the independent wiring layer 95. For example, the first electrode layer may be formed only by the independent wiring layer 95, as long as the first electrode layer is electrically connected to the liquid in the ink passage 16.

Although the invention has been described in connection with the embodiment, the invention is not limited thereto. In the above-described embodiment, the first cable layer 130 and the second cable layer 131 are drawn from the first independent electrode layer 110 and the second independent electrode layer 120 to the outside of the piezoelectric element retaining section 32, respectively. However, the first independent electrode layer 110 and the second independent electrode layer 120 may extend to the outside of the piezoelectric element retaining section 32.

In the above-described embodiment, the ink jet printing head has been described as an example of the liquid ejecting head. However, the invention is applicable to a general liquid ejecting head. Of course, the invention is applicable to a liquid ejecting head capable of ejecting liquid droplets other than ink and the method of inspecting the liquid ejecting head. Examples of the liquid ejecting head include various printing heads used in an image forming apparatus such as a printer, a color material ejecting head used in manufacturing a color filter such as a liquid display, an electrode material ejecting head used in forming electrodes such as an organic EL display and a FED (Field Emission Display), and a bio organism ejecting head used in manufacturing a bio chip.

What is claimed is:

1. A liquid ejecting head capable of ejecting a liquid from pressure generating chambers through nozzles by varying pressure of the pressure generating chambers by pressure generating units, the liquid ejecting head comprising:

a nozzle plate in which the nozzles are formed and which is formed of an insulating material;

a first passage forming board to which the nozzle plate is joined and in which a first liquid passage including the pressure generating chambers is formed and which is formed of an insulating material;

a vibration plate which is disposed on the first passage forming board and forms one surface of the first liquid passage; and a second passage forming board which is joined to the surface of the first liquid passage forming board close to the vibration plate and has a second liquid passage communicating with the first liquid passage, wherein a first electrode layer electrically connected to the liquid in the first liquid passage and a second electrode layer independent from the first electrode layer are disposed on the vibration plate, and wherein the first and second electrode layers each include a terminal drawn to the outside of a junction portion joining the first and second passage forming boards to each other.

2. The liquid ejecting head according to claim 1, wherein the first electrode layer has an exposure portion exposed to the first or second liquid passage and is electrically connected to the liquid in the first liquid passage via the exposure portion.

3. The liquid ejecting head according to claim 1, wherein the second passage forming board is provided with a retaining section which is a space receiving the pressure generating units, and the second electrode layer is disposed in a portion corresponding to the retaining section on the vibration plate.

4. The liquid ejecting head according to claim 3, wherein the second electrode layer is disposed in a portion facing an outer edge of the retaining section.

5. A method of inspecting the liquid ejecting head according to any one of claims 1 to 4, the method comprising:

inspecting a conductive state between the terminals of the first and second electrode layers in a state where the first liquid passage of the liquid ejecting head is stored with the liquid.

* * * * *